US006415448B1

(12) United States Patent
Glogover

(10) Patent No.: US 6,415,448 B1
(45) Date of Patent: Jul. 9, 2002

(54) STOCKING HAVING AN OPEN END WHICH CAN BE FOLDED BACK TO EXPOSE THE TOES AND METHOD OF USING THE SAME

(76) Inventor: Bonnie Glogover, 1203 River Rd., Apt. 8G, Edgewater, NJ (US) 07020

( * ) Notice: Subject to any disclaimer, the term of this patent is extended or adjusted under 35 U.S.C. 154(b) by 0 days.

(21) Appl. No.: 09/752,590

(22) Filed: Dec. 29, 2000

(51) Int. Cl.[7] ..... A41B 11/06
(52) U.S. Cl. ..... 2/239
(58) Field of Search ..... 2/239, 240, 241, 2/242, 61

(56) References Cited

U.S. PATENT DOCUMENTS

| | | | | | |
|---|---|---|---|---|---|
| 482,095 | A | * | 9/1892 | McClurg | |
| 3,090,963 | A | * | 5/1963 | Wittman | 2/239 |
| 3,111,676 | A | | 11/1963 | Artzt et al. | |
| 3,329,972 | A | * | 7/1967 | Schwab et al. | 2/239 |
| 3,975,929 | A | * | 8/1976 | Fregeolle | 66/172 E |
| 4,181,982 | A | | 1/1980 | Segovia | |
| 4,756,027 | A | * | 7/1988 | Buenos et al. | 2/123 |
| 5,054,129 | A | | 10/1991 | Baehr | |
| 5,067,179 | A | * | 11/1991 | Wormser | 2/269 |
| 5,097,537 | A | | 3/1992 | Ewing | |
| D358,703 | S | | 5/1995 | Moffre et al. | |
| 5,412,957 | A | * | 5/1995 | Bradberry et al. | 66/178 |
| 5,749,100 | A | * | 5/1998 | Rosenberg | 2/239 |
| 6,047,571 | A | * | 4/2000 | Juniman | 66/178 A |

* cited by examiner

*Primary Examiner*—Gloria M. Hale
*Assistant Examiner*—Alissa L. Hoey
(74) *Attorney, Agent, or Firm*—Richard M. Goldberg

(57) ABSTRACT

A stocking to be worn on a foot of a person, includes a tube of thin stretch nylon material having a main body and an end portion which forms a continuation of the main body, the end portion having a first open end and the main body having a second opposite open end, the main body and the end portion each having opposite first and second side edges when flattened, the end portion being folded back onto the main body along a fold line such that the first side edges are in alignment and the second side edges in alignment; and stitching connected between the first side edges and between the second side edges so that the first open end of the end portion remains open.

15 Claims, 3 Drawing Sheets

STOCKING HAVING AN OPEN END WHICH CAN BE FOLDED BACK TO EXPOSE THE TOES AND METHOD OF USING THE SAME

BACKGROUND OF THE INVENTION

The present invention relates generally to hosiery, and more particularly, is directed to a stocking having an open end which can be folded back to expose the toes for a pedicure.

Sheer stockings made of a stretchable fabric material, such as nylon, are commonly worn by women to enhance the appearance of their legs and to hide various aspects of their legs, such as varicose veins, unsightly scars, dimples or fatty deposits. However, in order to receive a pedicure, the woman must remove her stockings. Not only is this inconvenient, but also, can cause possible embarrassment to the woman.

It is known to provide pantyhose with open toe portions, for example, from U.S. Pat. No. 5,054,129 to Baehr and U.S. Design Pat. No. Des. 358,703 to Moffre et al.

In the Baehr patent, the foot portion is cut away at the front end and terminates in a forward edge which is spaced rearwardly from the wearer's toes. Accordingly, all of the wearer's toes extend through the open front end of the foot portion and are always exposed in use. A stretchable band is also secured at the front end, while still providing that the toes are always exposed in use. However, because the toes are always exposed, this pantyhose could not be used with open toed shoes, that is, since the toes are always exposed. Further, the necessity to secure the stretchable band to the hosiery further complicates the manufacturing process and adds to the cost of the product.

It is also known from U.S. Pat. No. 5,097,537 to Ewing to provide hosiery with detachable foot sections held to the leg portions by elastic means. This, however, also complicates the manufacturing process and adds to the cost of the product. Further, after the foot portions are removed and the woman receives a pedicure, the entire foot portion must be pulled up over the foot. This means that the material of the entire foot portion is dragged over the freshly painted nails, which could cause chipping of the nail polish.

It is also known from U.S. Pat. No. 4,181,982 to Segovia to provide a stocking with a convertible toe opening. However, this stocking requires a separate outer band and a separate inner band, both of which are secured to the sides of the foot enclosing portion by a seam. This stocking, while providing a similar effect to the present invention, requires two separate bands which must be secured together at a common seam to the foot enclosing portion. This, however, also complicates the manufacturing process and adds to the cost of the product.

OBJECTS AND SUMMARY OF THE INVENTION

Accordingly, it is an object of the present invention to provide a stocking that overcomes the problems with the aforementioned prior art.

It is another object of the present invention to provide a stocking which can be folded back to expose a person's toe or entire foot.

It is still another object of the present invention to provide such a stocking that is comfortable to wear.

It is yet another object of the present invention to provide such a stocking that need not be fully removed in order for a person to receive a pedicure.

It is a further object of the present invention to provide a stocking which is formed from a single piece of tubular stretch material that is merely folded over itself and sewn in position, without adding appreciable thickness.

It is a still further object of the present invention to provide a stocking that is relatively inexpensive and easy to manufacture, without greatly adding to the cost of the product.

In accordance with an aspect of the present invention, a stocking to be worn on a foot of a person, includes a tube of thin stretch material having a main body and an end portion which forms a continuation of the main body. The end portion has a first open end and the main body has a second open end opposite the first open end. Each of the main body and the end portion have opposite first and second side edges when the main body and the end portion, respectively, are flattened. The end portion is folded back onto the main body along a fold line such that the opposite first and second side edges of the end portion are substantially in alignment with the respective opposite first and second side edges of the main body. A securing arrangement is connected between the first side edges of the main body and the end portion and between the second side edges of the main body and the end portion such that the first open end of the end portion remains open.

Preferably, the securing arrangement includes stitches which connect together the first side edges of the main body and the end portion and which connect together the second side edges of the main body and the end portion. In one embodiment, the stitching is spaced slightly inwardly from the first and second side edges of the main body. The tube is preferably made from a nylon material.

In one embodiment, the end portion is positioned to a bottom of the foot when the stocking is worn on the foot, and in another embodiment, the end portion is positioned to a top of the foot when the stocking is worn on the foot.

The end portion includes opposing first and second layers between the first and second side edges thereof, and the main body includes opposing third and fourth second layers between the first and second side edges thereof. The first through third layers are all positioned in overlying relation to each other at either the bottom or top of the foot when the stocking is worn on the foot in covering relation to toes of the foot, and the fourth layer is positioned in overlying relation to the other of the bottom and top of the foot when the stocking is worn on the foot in covering relation to the toes of the foot. In one embodiment, the first through third layers are all positioned in overlying relation to each other at the bottom of the foot when the stocking is worn on the foot in covering relation to toes of the foot, and the fourth layer is positioned in overlying relation to the top of the foot when the stocking is worn on the foot in covering relation to the toes of the foot. In another embodiment, the first through third layers are all positioned in overlying relation to each other at the top of the foot when the stocking is worn on the foot in covering relation to toes of the foot, and the fourth layer is positioned in overlying relation to the bottom of the foot when the stocking is worn on the foot in covering relation to the toes of the foot.

Further, the first and third layers are both positioned in overlying relation to each other at either the bottom or top of the foot when the stocking is worn on the foot in a manner to expose toes of the foot, and the second and fourth layers are both positioned in overlying relation to each other at the other of the bottom and top of the foot when the stocking is worn on the foot in a manner to expose toes of the foot. In one embodiment, the first and third layers are both positioned in overlying relation to each other at the bottom of the foot when the stocking is worn on the foot in a manner to expose the toes of the foot, and the second and fourth layers are both positioned in overlying relation to each other at the top of the foot when the stocking is worn on the foot in a manner to expose the toes of the foot. In another embodiment, the first and third layers are both positioned in overlying relation to each other at the top of the foot when the stocking is worn on the foot in a manner to expose the toes of the foot, and the second and fourth layers are both positioned in overlying relation to each other at the bottom of the foot when the stocking is worn on the foot in a manner to expose the toes of the foot.

In accordance with an another aspect of the present invention, a method is provided for exposing at least toes of a foot of a person with a stocking worn on the foot, without completely removing the stocking. In this case, the stocking is of a type including a tube of thin stretch material having a main body and an end portion which forms a continuation of the main body, the end portion having a first open end and the main body having a second open end opposite the first open end, each of the main body and the end portion having opposite first and second side edges when the main body and the end portion, respectively, are flattened, the end portion being folded back onto the main body along a fold line such that the opposite first and second side edges of the end portion are in alignment with the respective opposite first and second side edges of the main body, the end portion including opposing first and second layers between the first and second side edges thereof, and the main body including opposing third and fourth layers between the first and second side edges thereof, and a securing arrangement connected between the first side edges of the main body and the end portion and between the second side edges of the main body and the end portion such that the first open end of the end portion remains open. The method includes the steps of positioning the stocking on the foot of the person such that the first through third layers are all positioned in overlying relation to each other at either the bottom or top of the foot when the stocking is worn on the foot in covering relation to toes of the foot, and the fourth layer is positioned in overlying relation to the other of the bottom and top of the foot when the stocking is worn on the foot in covering relation to the toes of the foot; and then stretching the first layer of the end portion around the toes of the foot to the other of the bottom and top of the foot in overlying relation to the fourth layer to expose the toes of the foot.

In one embodiment, the step of positioning includes the step of positioning the stocking on the foot of the person such that the first through third layers are all positioned in overlying relation to each other at the bottom of the foot when the stocking is worn on the foot in covering relation to toes of the foot, and the fourth layer is positioned in overlying relation to the top of the foot when the stocking is worn on the foot in covering relation to the toes of the foot, and the step of stretching includes the step of stretching the first layer of the end portion around the toes of the foot to the top of the foot in overlying relation to the fourth layer to expose the toes of the foot.

In another embodiment, the step of positioning includes the step of positioning the stocking on the foot of the person such that the first through third layers are all positioned in overlying relation to each other at the top of the foot when the stocking is worn on the foot in covering relation to toes of the foot, and the fourth layer is positioned in overlying relation to the bottom of the foot when the stocking is worn on the foot in covering relation to the toes of the foot, and the step of stretching includes the step of stretching the first layer of the end portion around the toes of the foot to the bottom of the foot in overlying relation to the fourth layer to expose the toes of the foot.

The above and other objects, features and advantages of the invention will become readily apparent from the following detailed description thereof which is to be read in connection with the accompanying drawings.

DETAILED DESCRIPTION

Figure 1:
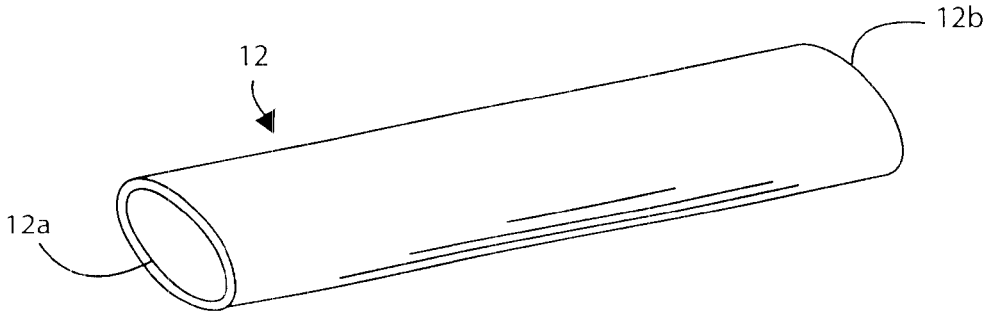
FIG. 1 is a perspective view of a tubular nylon material used to make a stocking according to the present invention.
Figure 2:
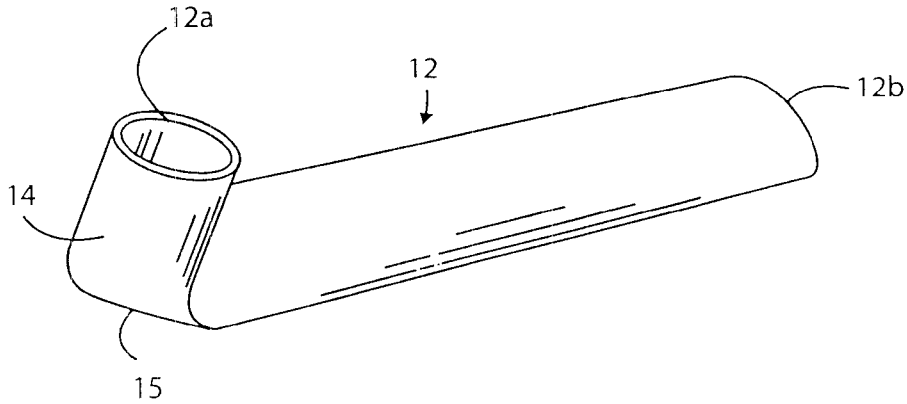
FIG. 2 is a perspective view of the tubular nylon material partially folded over onto itself in the process of making the stocking according to the present invention.
Figure 3:
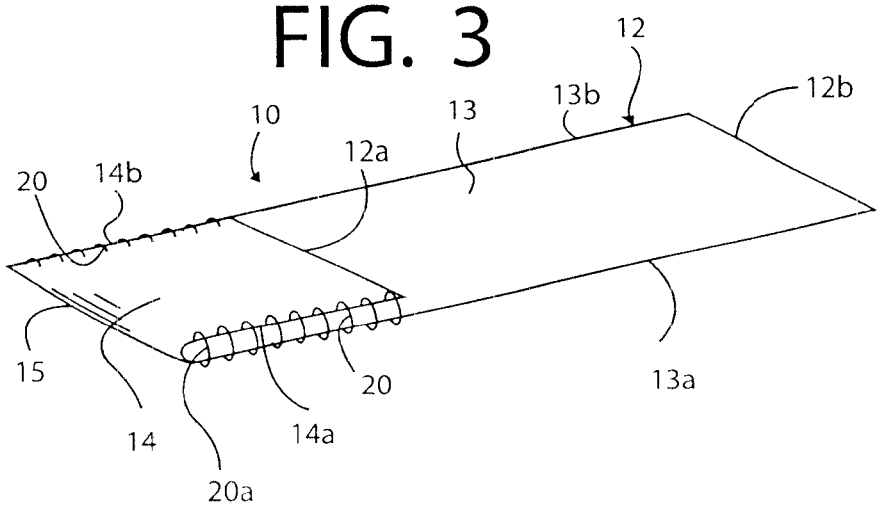
FIG. 3 is a perspective view of a flattened stocking according to the present invention, made from the tubular nylon material of FIGS. 1 and 2.

Referring to the drawings in detail, and initially to FIGS. 1–3, a stocking 10 according to the present invention is formed from a tube 12 of stretch material, such as nylon, cotton blends and the like, which are conventional materials used to form women's stockings. Thus, tube 12 will have an extremely small wall thickness, as with conventional nylon stockings. In this regard, the wall thickness in the figures is enlarged and thereby exaggerated in order to better illustrate the invention. Tube 12 can be effectively transparent when stretched, or can be provided with a color. Tube 12 further includes opposite open ends 12*a* and 12*b*.

Reference to stockings throughout this application including the claims, includes knee high stockings, full leg stockings, pantyhose, socks and the like, which are intended to cover the foot and at least a portion of the leg of the person. In this regard, the length of stocking 10 will vary depending upon the type of stocking. It will be appreciated that the present invention will be applied to stockings 10 for both feet.

In forming stocking 10, one end portion 14 of tube 12 is folded over onto itself along a fold line 15, as shown in the intermediate folded condition in FIG. 2 and the fully folded condition in FIG. 3. As a result, tube 12 includes a main body 13 and end portion 14 which forms a continuation of main body 13. The length of folded end portion 14 can be any suitable length, but a length of about three inches is preferred.

Main body 13 includes opposite first and second side edges 13*a* and 13*b* when main body 13 is flattened, as shown in FIG. 3. In like manner, end portion 14 includes opposite first and second side edges 14*a* and 14*b* when end portion 14 is flattened, as also shown in FIG. 3. Then, side edges 13*a* and 14*a* of main body 13 and folded end portion 14, which are in overlying and aligned relation, are secured together by any suitable means, such as stitching 20, heat sealing, ultrasonic sealing or the like, to form the finished stocking 10. In like manner, side edges 13*b* and 14*b* of main body 13 and folded end portion 14, which are in overlying and aligned relation, are secured together by any suitable means, such as stitching 20, heat sealing, ultrasonic sealing or the like, to form the finished stocking 10. However, end 12*a* which is part of end portion 14, remains open at all times, regardless of stitching 20. As an alternative, side edges 13*a*, 14*a* and side edges 13*b*, 14*b* can be stretched apart slightly before stitching, in order to provide a pre-tensioned effect, whereby the nylon material better hugs a foot 22 when worn.

Figure 4:
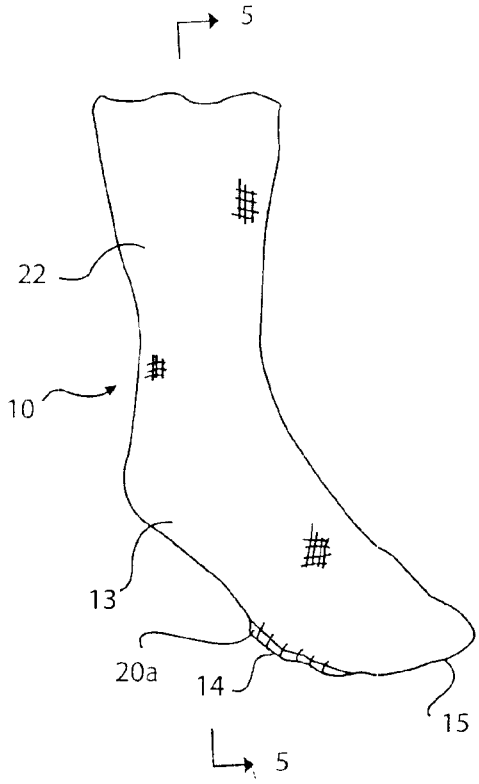
FIG. 4 is a perspective view of a foot with the stocking according to the present invention worn thereon.

Stocking 10 is shown on foot 22 of a person in FIG. 4 in the normal wearing condition. In this condition, folded end portion 14 is positioned at the bottom of foot 22, with the ends of the toes of the person extending to fold line 15. Accordingly, as shown best in the cross-sectional view of FIG. 5, there are three layers 24, 26 and 28 of nylon at the bottom of foot 22, and one layer 30 of nylon at the top of foot 22, with foot 22 being entirely covered. Specifically, layer 28 is stretched around toes 32 of foot 22, and extends to the bottom of foot 22. It will be appreciated that layers 24 and 30 form main body 13, while layers 26 and 28 form end portion 14.

This arrangement gives the appearance of a conventional nylon stocking. Because of the thinness of the layers 24, 26 and 28, there is no discomfort to a person walking thereon. Further, stitching 20 is at the side edges and is therefore not noticeable when stocking 10 is worn. Alternatively, stitching 20 can be provided slightly inwardly of overlain side edges 13*a* and 13*b* so that when stocking 10 is worn, stitching 10 appears at the bottom of the foot, adjacent the side edges.

Figure 5:
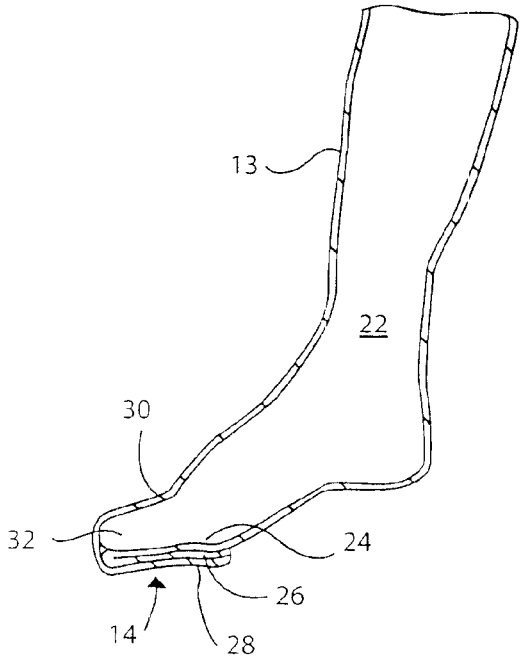
FIG. 5 is a cross-sectional view of the foot and stocking of FIG. 4, taken along line 5—5 thereof.
Figure 6:
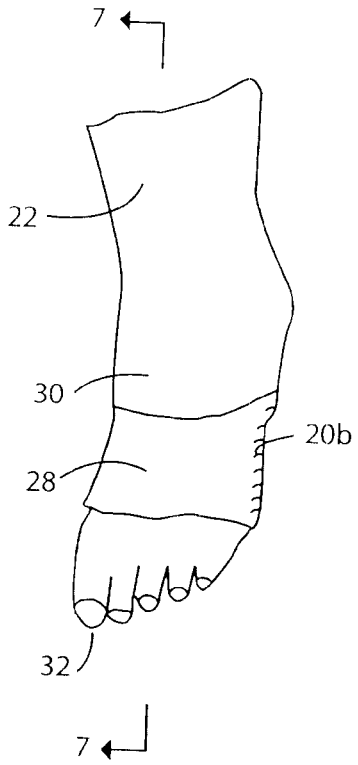
FIG. 6 is a perspective view of a foot with the stocking folded up to expose the toes.
Figure 7:
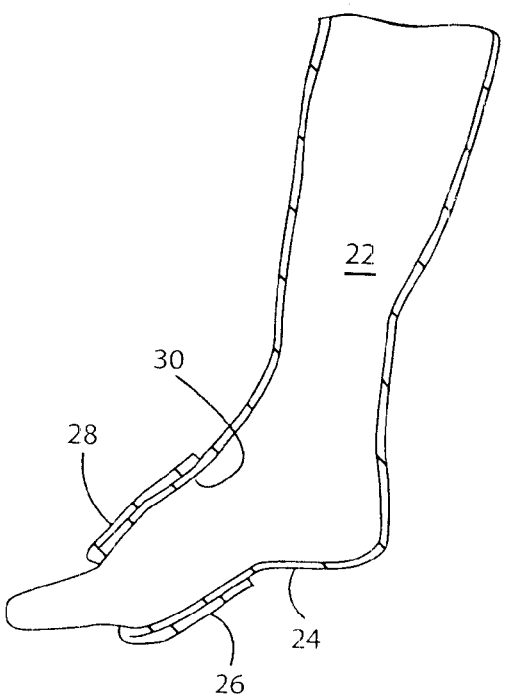
FIG. 7 is a cross-sectional view of the foot and stocking of FIG. 6, taken along line 7—7 thereof.

When it is desired to reveal the toes 32 of foot 22, for example, for receiving a pedicure, layer 28 is pulled forwardly toward toes 32, then is pulled up and over toes 32, and finally is pulled rearwardly onto the top of layer 30, as shown in FIGS. 6 and 7. At the same time, because of the connection by stitching 20, layer 26 is also pulled rearwardly on layer 24, as shown in FIGS. 6 and 7. In this position, stitching 20 is inverted from the position shown in FIG. 4, that is, the outer portion 20*a* of stitching 20 shown in FIGS. 3 and 4 is now not visible between the different layers, while the inner portion 20*b* of stitching 20 which is encompassed within the layers in FIGS. 4 and 5 is now visible to the outside of the different layers, as shown in FIGS. 6 and 7. Because of the stretchy nature of the nylon material, this change in condition becomes relatively easy to perform. Thereafter, the woman can receive her pedicure. After the nail polish has dried, it is only necessary to reverse the above procedure, that is, to stretch layer 28 around toes 32 to the bottom of foot 22 to the position shown in FIGS. 4 and 5.

It will therefore be appreciated that a simple construction of stocking 10 is provided which can be folded back to expose a person's toe or entire foot without fully removing stocking 10, in order for a person to receive a pedicure. Further, during normal use, stocking 10 is comfortable to wear.

Unlike the prior art, stocking 10 is formed from a single piece of tubular stretch material that is merely folded over itself and sewn in position, without adding appreciable thickness. Further, stocking 10 is relatively inexpensive and easy to manufacture, without greatly adding to the cost of the product.

It will be appreciated that various modifications within the scope of the claims can be made to the present invention. For example, while folded end portion 14 has been disclosed as being folded along the bottom of foot 22 so as not to be visible during normal usage, stocking 10 can be worn such that folded end portion 14 is positioned at the top of foot 22 during normal wear. This could occur in situations where a closed shoe is worn, which hides folded end portion 14 during normal wear. In order to expose the toes, the uppermost of the three layers on top of foot 22 would be positioned to the bottom of foot 22.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A stocking to be worn on a foot of a person, comprising:

a single continuous tube of thin stretch material having a main body and an end portion which forms a continuation of said main body, said end portion having a first open end and said main body having a second open end opposite said first open end, each of said main body and said end portion having opposite first and second side edges when said main body and said end portion, respectively, are flattened, said end portion being folded back onto said main body along a fold line such that the opposite first and second side edges of said end portion are substantially in alignment with the respective opposite first and second side edges of said main body; and a securing arrangement which connects said first side edge of said main body with said first side edge of said end portion and which connects said second side edge of said main body and said second side edge of said end portion such that said first open end of said end portion remains open and such that the entire said end portion is selectively foldable back on an upper portion of said main body so as to be positioned to a top of the foot of the person when the stocking is worn or a lower portion of said main body so as to be positioned to a bottom of the foot of the person when the stocking is worn.

2. A stocking according to claim 1, wherein said securing arrangement includes stitches which connect together said first side edges of said main body and said end portion and which connect together said second side edges of said main body and said end portion.

3. A stocking according to claim 1, wherein said stitching is spaced slightly inwardly from said first and second side edges of said main body.

4. A stocking according to claim 1, wherein said tube is made from a nylon material.

5. A stocking according to claim 1, wherein said end portion is positioned to the bottom of the foot when the stocking is worn on the foot.

6. A stocking according to claim 1, wherein said end portion is positioned to the top of the foot when the stocking is worn on the foot.

7. A stocking according to claim 1, wherein:

said end portion includes opposing first and second layers between the first and second side edges thereof;

said main body includes opposing third and fourth second layers between the first and second side edges thereof;

said first through third layers are all positioned in overlying relation to each other at one of the bottom and top of the foot when the stocking is worn on the foot in covering relation to toes of the foot; and said fourth layer is positioned in overlying relation to the other of the bottom and top of the foot when the stocking is worn on the foot in covering relation to the toes of the foot.

8. A stocking according to claim 7, wherein said first through third layers are all positioned in overlying relation to each other at the bottom of the foot when the stocking is worn on the foot in covering relation to toes of the foot, and said fourth layer is positioned in overlying relation to the top of the foot when the stocking is worn on the foot in covering relation to the toes of the foot.

9. A stocking according to claim 7, wherein said first through third layers are all positioned in overlying relation to each other at the top of the foot when the stocking is worn on the foot in covering relation to toes of the foot, and said fourth layer is positioned in overlying relation to the bottom of the foot when the stocking is worn on the foot in covering relation to the toes of the foot.

10. A stocking according to claim 1, wherein:

said end portion includes opposing first and second layers between the first and second side edges thereof;

said main body includes opposing third and fourth second layers between the first and second side edges thereof;

said first and third layers are both positioned in overlying relation to each other at one of the bottom and top of the foot when the stocking is worn on the foot in a manner to expose toes of the foot; and said second and fourth layers are both positioned in overlying relation to each other at the other of the bottom and top of the foot when the stocking is worn on the foot in a manner to expose toes of the foot.

11. A stocking according to claim 10, wherein said first and third layers are both positioned in overlying relation to each other at the bottom of the foot when the stocking is worn on the foot in a manner to expose the toes of the foot, and said second and fourth layers are both positioned in overlying relation to each other at the top of the foot when the stocking is worn on the foot in a manner to expose the toes of the foot.

12. A stocking according to claim 10, wherein said first and third layers are both positioned in overlying relation to each other at the top of the foot when the stocking is worn on the foot in a manner to expose the toes of the foot, and said second and fourth layers are both positioned in overlying relation to each other at the bottom of the foot when the stocking is worn on the foot in a manner to expose the toes of the foot.

13. A method of exposing at least toes of a foot of a person with a stocking worn on the foot, without completely removing the stocking, the stocking being of a type including a tube of thin stretch material having a main body and an end portion which forms a continuation of said main body, said end portion having a first open end and said main body having a second open end opposite said first open end, each of said main body and said end portion having opposite first and second side edges when said main body and said end portion, respectively, are flattened, said end portion being folded back onto said main body along a fold line such that the opposite first and second side edges of said end portion are in alignment with the respective opposite first and second side edges of said main body, said end portion including opposing first and second layers between the first and second side edges thereof, and said main body including opposing third and fourth layers between the first and second side edges thereof; and a securing arrangement connected between said first side edges of said main body and said end portion and between said second side edges of said main body and said end portion such that said first open end of said end portion remains open, said method comprising the steps of:

selectively folding back the entire said end portion on one of:

an upper portion of said main body so as to be positioned to a top of the foot of the person when the stocking is worn, and a lower portion of said main body so as to be positioned to a bottom of the foot of the person when the stocking is worn;

positioning the stocking on the foot of the person such that said first through third layers are all positioned in overlying relation to each other at one of the bottom and top of the foot when the stocking is worn on the foot in covering relation to toes of the foot, and said fourth layer is positioned in overlying relation to the other of the bottom and top of the foot when the stocking is worn on the foot in covering relation to the toes of the foot; and stretching the first layer of the end portion around the toes of the foot to the other of the bottom and top of the foot in overlying relation to the fourth layer to expose the toes of the foot.

14. A method according to claim 13, wherein:

said step of positioning includes the step of positioning the stocking on the foot of the person such that said first through third layers are all positioned in overlying relation to each other at the bottom of the foot when the stocking is worn on the foot in covering relation to toes of the foot, and said fourth layer is positioned in overlying relation to the top of the foot when the stocking is worn on the foot in covering relation to the toes of the foot; and said step of stretching includes the step of stretching the first layer of the end portion around the toes of the foot to the top of the foot in overlying relation to the fourth layer to expose the toes of the foot.

15. A method according to claim 13, wherein:

said step of positioning includes the step of positioning the stocking on the foot of the person such that said first through third layers are all positioned in overlying relation to each other at the top of the foot when the stocking is worn on the foot in covering relation to toes of the foot, and said fourth layer is positioned in overlying relation to the bottom of the foot when the stocking is worn on the foot in covering relation to the toes of the foot; and said step of stretching includes the step of stretching the first layer of the end portion around the toes of the foot to the bottom of the foot in overlying relation to the fourth layer to expose the toes of the foot.

* * * * *

UNITED STATES PATENT AND TRADEMARK OFFICE

CERTIFICATE OF CORRECTION

PATENT NO. : 6,415,448 B1
DATED : July 9, 2002
INVENTOR(S) : Bonnie Glogover

It is certified that error appears in the above-identified patent and that said Letters Patent is hereby corrected as shown below:

Column 6,
Lines 34-40, after "said" (first occurrence), delete "first open end of said end portion remains open and such that the entire said end portion is selectively foldable back on an upper portion of said main body so as to be positioned to a top of the foot of the person when the stocking is worn or a lower portion of said main body so as to be positioned to a bottom of the foot of the person when the stocking is worn" and insert -- stocking can assume all of the following configurations:

a) the first open end of said end portion remains open, b) the entire said end portion is selectively foldable back on an upper portion of said main body so as to be positioned to a top of the foot of the person when the stocking is worn and c) the entire said end portion is selectively foldable back on a lower portion of said main body so as to be positioned to a bottom of the foot of the person when the stocking is worn. --

Column 8,
Line 29, after "foot" insert -- such that said stocking can assume all of the following configurations:

a) the first open end of said end portion remains open, b) the entire said end portion is selectively foldable back on an upper portion of said main body so as to be positioned to a top of the foot of the person when the stocking is worn and c) the entire said end portion is selectively foldable back on a lower portion of said main body so as to be positioned to a bottom of the foot of the person when the stocking is worn. --

Signed and Sealed this

Twelfth Day of November, 2002

*Attest:*

*Attesting Officer*

JAMES E. ROGAN
*Director of the United States Patent and Trademark Office*